US006435576B1

(12) United States Patent
Kusta

(10) Patent No.: US 6,435,576 B1
(45) Date of Patent: Aug. 20, 2002

(54) CLOSURE RING ASSEMBLY FOR AN OPEN-HEAD DRUM

(76) Inventor: Lenix Fred Kusta, 3269 Tyler Rd., Birmingham, AL (US) 35216

( * ) Notice: Subject to any disclaimer, the term of this patent is extended or adjusted under 35 U.S.C. 154(b) by 0 days.

(21) Appl. No.: 09/818,017

(22) Filed: Mar. 26, 2001

Related U.S. Application Data

(63) Continuation-in-part of application No. 09/356,915, filed on Jul. 19, 1999, now abandoned.

(51) Int. Cl.[7] ..... B65D 45/30

(52) U.S. Cl. ..... 292/256.67; 292/256.6; 292/256.65

(58) Field of Search ..... 292/256.6, 256.65, 292/256.67; 220/319, 320; 215/276, 275, 274; 403/546, 399; 411/546, 399

(56) References Cited

U.S. PATENT DOCUMENTS

| | | | | |
|---|---|---|---|---|
| 506,928 | A | | 10/1893 | Newman |
| 2,486,565 | A | * | 11/1949 | Kojan et al. |
| 2,625,721 | A | * | 1/1953 | Lockhart |
| 2,688,170 | A | | 9/1954 | Balzer |
| 2,915,330 | A | | 12/1959 | Verbiar |
| 3,022,103 | A | * | 2/1962 | Klygis |
| 3,447,825 | A | | 6/1969 | Santoni |
| 3,907,349 | A | | 9/1975 | Kane |
| 4,982,864 | A | | 1/1991 | Kusta |
| 5,193,864 | A | | 3/1993 | Coleman |
| 5,215,206 | A | | 6/1993 | Siblik |
| 5,584,410 | A | | 12/1996 | Siblik |
| 5,802,780 | A | * | 9/1998 | Hammerschlag ..... 52/105 |
| 5,829,624 | A | | 11/1998 | Skolnik et al. |
| 5,971,190 | A | | 10/1999 | Mannino |

* cited by examiner

*Primary Examiner*—Teri Pham Luu
(74) *Attorney, Agent, or Firm*—Christopher A. Holland; Robert J. Veal; Burr & Forman LLP

(57) ABSTRACT

An annular closure ring and bolt assembly for securing a lid or cover in sealed relation with an open-head drum is provided in which an annular split closure ring is closed by tightening a bolt between a pair of laterally spaced lugs attached to opposite ends of the closure ring. Each lug includes a hole to receive the bolt wherein at least one lug hole is unthreaded, and the bolt includes a shoulder or sleeve such that when the bolt is inserted into the unthreaded hole, the shoulder fits substantially flush with that unthreaded hole. The bolt engages either a threaded hole in one of the lugs or a jam nut to draw the lugs together and tighten the closure ring around the drum. The tight engagement between the unthreaded hole of the lug and the shoulder of the bolt thereby reduces movement of the bolt within the unthreaded hole to secure the connection of the ring around the open-head drum.

22 Claims, 5 Drawing Sheets

CLOSURE RING ASSEMBLY FOR AN OPEN-HEAD DRUM

RELATED MATERIALS

The present application is a continuation-in-part application of pending U.S. patent application Ser. No. 09/356,915, filed Jul. 19, 1999, abandoned, which is incorporated herein by reference.

FIELD OF THE INVENTION

The present invention relates to the field of storage containers and closure assemblies for securing storage container lids or covers to the open ends of storage containers, and, more specifically, the present invention relates to an improved closure ring assembly used to secure a drum lid to an open-head drum.

BACKGROUND OF THE INVENTION

Open-head drums are commonly used as containers for storage and transportation of bulk materials. These drums have a cylindrical opening to receive materials, and they conventionally include an annular closure ring assembly to secure a lid or similar covering around the cylindrical opening of the drum. To meet governmental regulations and industry standards, the closure ring assemblies of these drums must be able to withstand being tested by being dropped onto a rigid, non-resilient, smooth, flat and horizontal surface, where the point of impact is the most vulnerable part of the base of the intermediate bulk container being tested. Following the drop, the intermediate bulk container is examined to verify that the seal is maintained and that the contents are protected. Therefore, to meet these test requirements, a reliable closure ring assembly must be provided.

Failures with open-head drums frequently occur in the steel drum industry. Conventional open-head drums face hydrostatic leaks that occur when the drums are either improperly sealed or placed in heated areas where a build up of pressure can occur. Furthermore, conventional open-head drums also face drop failure due to improper sealing methods or by being accidentally dropped from a truck or rail shipment. To prevent hydrostatic and drop failure, several standards organizations developed hydrostatic and drop height limits.

A conventional closure ring assembly 10 is shown in FIGS. 1 and 2, which is similar to the closure ring assembly described in U.S. Pat. No. 5,584,410 issued to Siblik ("the Siblik patent"). This closure ring assembly 10 includes the following elements: a split closure ring 12 having two adjacent ends 22, 24; a first lug 16 having a unthreaded hole 17; a second lug 14 having an threaded hole 13; a conventional bolt 18 having a threaded cylindrical member 15 and a head 19 (shown in FIG. 3); and a jam nut 20. A first lug 16 is attached to the first end 22 of the closure ring 12, and a second lug 14 is attached to the second end 24 of the closure ring 12.

To secure the lid to the opening of the drum, the closure ring 12 is placed around the lid and drum, and the threaded cylindrical member 15 of bolt 18 is inserted through the unthreaded hole 17 to engage the threaded hole 13. As the threaded cylindrical member 15 engages the threaded hole 13, the two ends 22, 24 of the closure ring 12 are drawn together to tighten the closure ring 12 around the lid and drum.

A common problem with the closure ring assembly 10 described above is the space 21 found between the bolt 18 and the unthreaded hole 17 (see FIG. 2). This space 21 allows undesired movement of the bolt 18 within the closure ring 12 when a force is applied to the drum, which allows movement of the closure ring 12. For example, if the drum is dropped or rolled, the space 21 between the bolt 18 and the unthreaded lug 16 allows movement of the bolt 18 such that the lugs 14, 16 become unaligned and the connection between the bolt 18 and the threaded lug 14 is affected, which can disrupt the sealed relationship between the lid and the drum and cause the lid to become displaced from the drum.

To compensate for this problem, a jam nut 20 (shown in FIGS. 1 and 2) is used to secure the assembly 10. The bolt 18 in this design is inserted through the unthreaded hole 17 and engages the threaded hole 13 to draw the two ends 22, 24 of the split closure ring 12 together around the open-head drum. The jam nut 20 is included in the assembly 10 to engage the threaded cylindrical member 15 and secure the lug 16 between the head 19 and the jam nut 20, which aids the closure ring assembly 10 to withstand impact forces without moving the bolt 18 within the space 21. However, a problem that arises with the use of the jam nut 20 is that the distance between the lugs 14, 16 is increased due to the location of the jam nut 20, thereby loosening the connection of the closure ring 12 around the lid and drum.

Additionally, other designs have been provided to achieve a seal for an open-head drum that prevents against the leakage of the contents therein. For example, U.S. Pat. No. 3,907,349 to Kane ("the Kane patent") describes an end closure ring assembly having an overlapping, light gauge ring that is used in an attempt to completely seal the drum. Light gauge rings as described in Kane conventionally have a width of approximately 0.052 inches. As a result, such rings are not able to securely attach lids as required by industry standards. Consequently, Kane further requires the ring to partially overlap to secure a lid to provide the most secure connection. Moreover, such a design requires epoxy or similar adhesive to keep from leaking.

What is needed, then, and not found in the prior art, is a closure ring assembly for open-head drums that will reduce the movement in the closure ring once the closure ring has been assembled on the drum and consequently provide a secure connection between the closure ring and the drum.

SUMMARY OF THE INVENTION

It is an object of the present invention to provide an improved closure ring assembly for use with open-head drums having a heavy gauge ring as required by industry standards that is able to secure a lid to the drum.

It is an object of the present invention to provide an improved closure ring assembly for use with open-head drums that overcomes the problem of undesired radial and axial movement of the closure ring.

It is another object of the present invention to provide an improved closure ring assembly for use with storage drums that eliminates the number of required elements between the lugs so that the closure ring may provide a tighter connection with the open-head drum.

These and other objects of the present invention are accomplished through an improved annular closure ring and bolt assembly used to secure a lid or cover to a conventional open-head drum. The annular closure ring is split to provide two adjacent ends that are capable of surrounding an open-head drum. Attached to the two ends are two lugs that have holes passing transversely through the lugs. A bolt is provided to intersect and engage the holes of the lugs to draw the lugs and the ends of the closure ring together around the lid and the drum.

More particularly, in the first embodiment of the invention, the first lug includes a purposely-large unthreaded hole that is necessary to eliminate cross threading and the second lug includes a threaded hole. The bolt is designed to pass through the large unthreaded hole to engage the threaded hole. To reduce unwanted movement between the large unthreaded lug and the bolt when the annular split ring is tightened around the lid and the drum, a shoulder is used with the bolt. The shoulder may be integrally formed onto the bolt, or it may be a slip sleeve or threaded sleeve that may be positioned by the head of the bolt. The diameter of the shoulder is designed to be slightly less than the diameter of the large unthreaded hole so that when the bolt engages the lugs, the shoulder is substantially flush with the periphery of the large unthreaded hole. The shoulder thereby reduces the movement that is allowable within the large unthreaded hole to secure the connection of the bolt to the lugs and reinforce the connection of the annular closure ring to the open-head drum.

Additionally, although not required, a jam nut may be included in this assembly to further secure the bolt to the lugs. The jam nut can engage the bolt between the lugs, as with conventional closure ring assemblies, to further secure the connection of the bolt.

In a second embodiment, both lugs include unthreaded holes. The bolt thereby passes through the unthreaded holes in the lugs to engage a jam nut which secures the bolt to the lugs. The shoulder of the bolt in this embodiment is extended so that it will be substantially flush with the periphery of the both holes when the closure ring is attached to the drum, which reduces the amount of movement allowable within the holes to secure the connection of the bolt to the lugs and to reinforce the connection of the annular closure ring to the open-head drum.

These and other objects and advantages of the invention will become apparent from the following detailed description of the preferred embodiment of the invention.

BRIEF DESCRIPTION OF THE DRAWINGS

An annular closure ring and fastening assembly embodying the features of the present invention is depicted in the accompanying drawings which form a portion of this disclosure and wherein.

DESCRIPTION OF THE PREFERRED EMBODIMENTS

Figure 4:
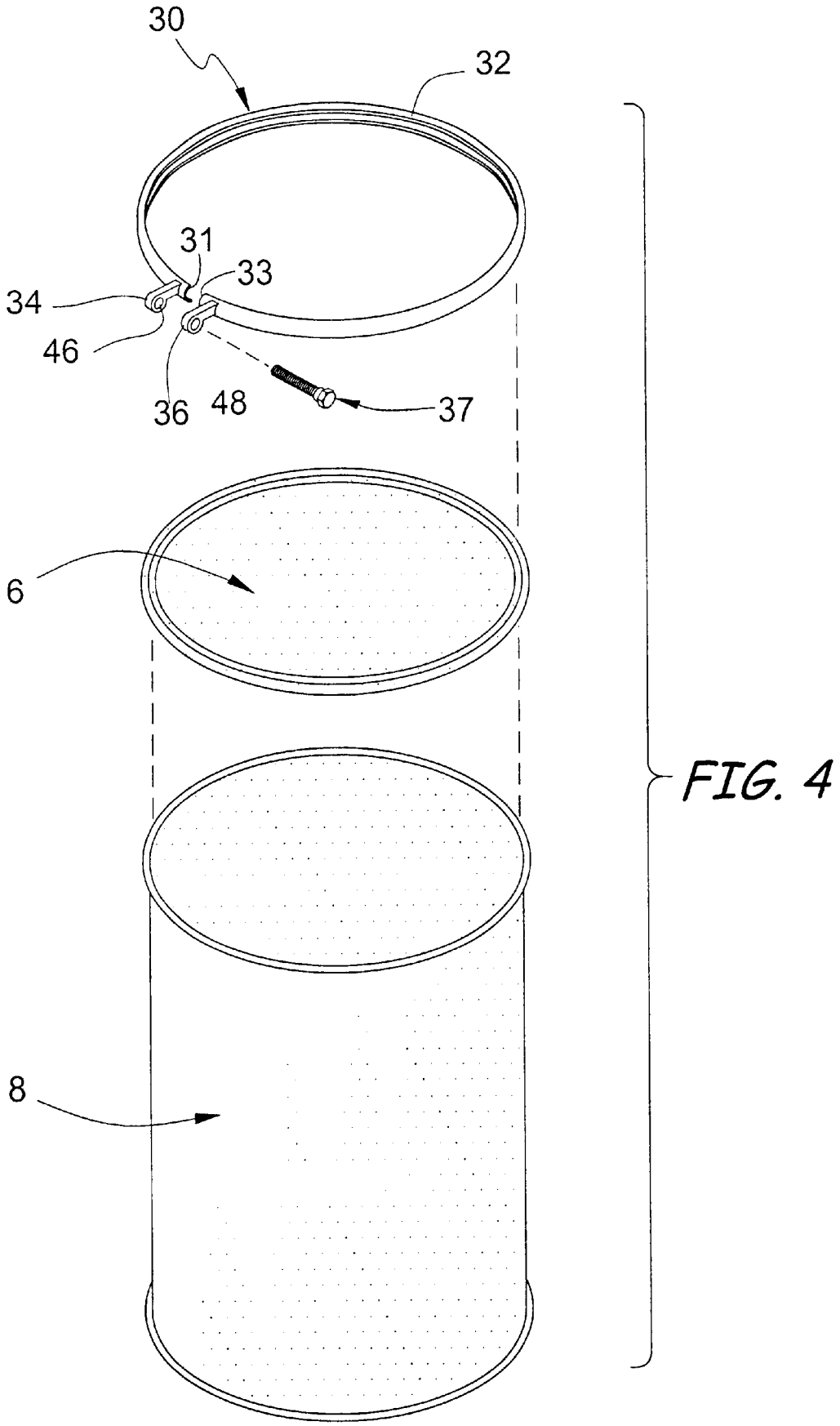
FIG. 4 is an exploded perspective view of an open-head drum, lid, and closure ring assembly of the present invention.
Figure 6:
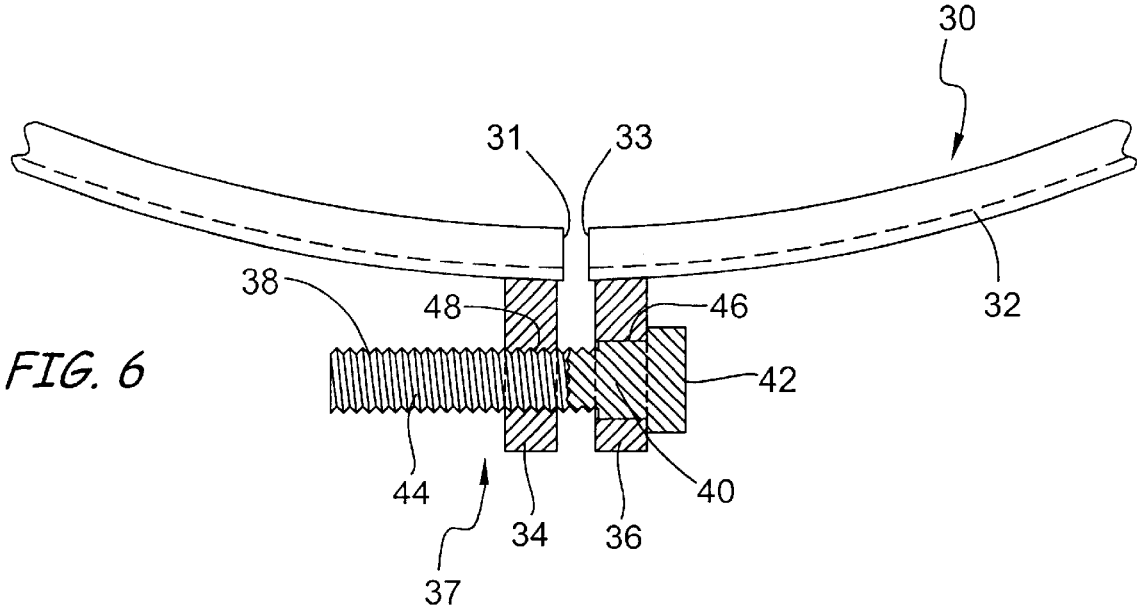
FIG. 6 is a partial sectional view of a first embodiment of the closure ring assembly of the present invention having a lug with a threaded hole to receive the bolt and shoulder of the bolt.

Referring to FIGS. 4 and 6, an exploded view of the closure ring assembly 30 of the present invention is shown in conjunction with a lid 6 and open-head drum 8. The preferred embodiment of the closure ring assembly 30 includes: a closure ring 32 that is split to provide adjacent ends 31, 33; a pair of lugs 34, 36 attached to the ends 31, 33 of the split closure ring 32; and a fastening assembly 37 for connecting the ends 31, 33 of the closure ring 32. The fastening assembly 37 of the closure ring assembly 30 is included to limit undesired radial and axial movement.

Figure 5A:
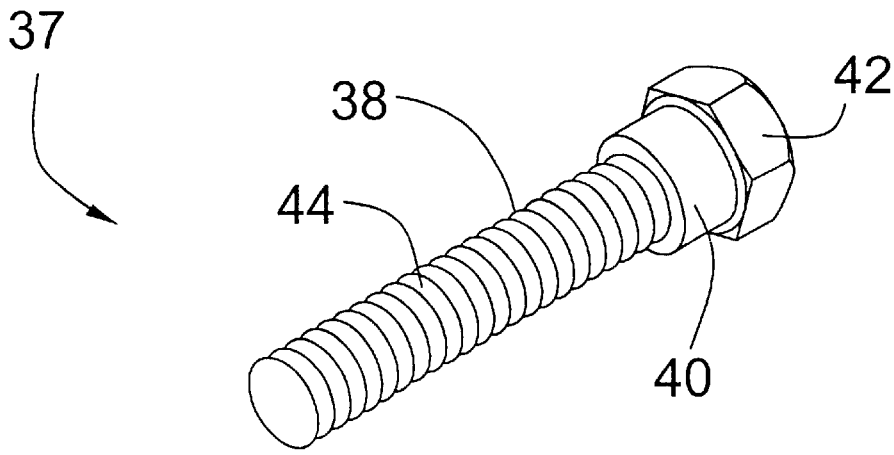
FIG. 5A is a perspective view of a bolt used in one embodiment of the fastening assembly of the closure ring assembly of the present invention, with the bolt having a cylindrical shoulder rigidly affixed.
Figure 5B:
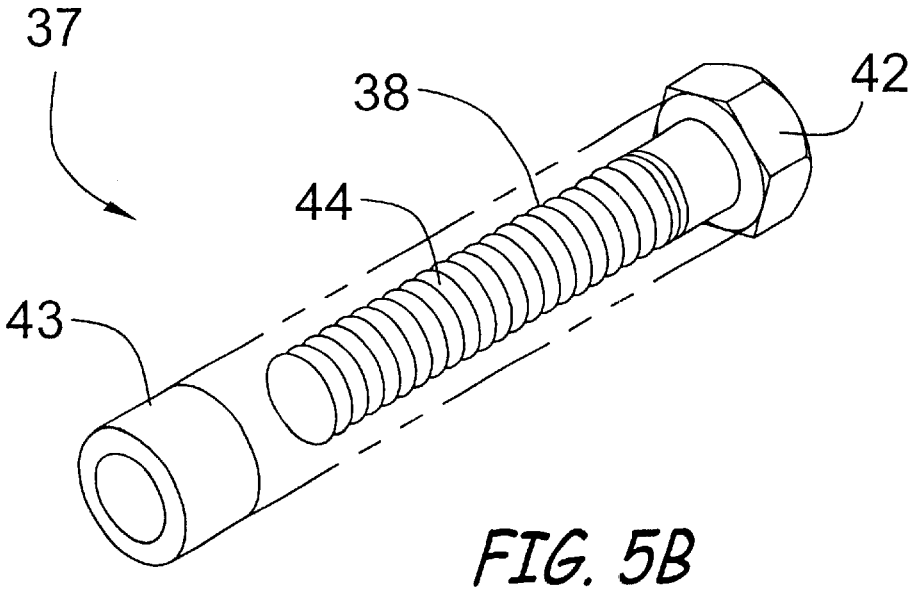
FIG. 5B is a perspective view of the bolt used in another embodiment of the fastening assembly of the closure ring assembly of the present invention, with a slip sleeve being affixed around a threaded cylindrical member of the bolt.
Figure 5C:
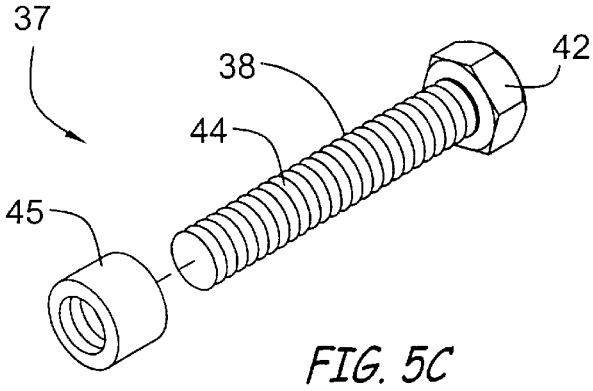
FIG. 5C is a perspective view of the bolt used in another embodiment of the fastening assembly of the closure ring assembly of the present invention, with a threaded sleeve being affixed around a threaded cylindrical member of the bolt.

Several embodiments of the fastening assembly 37 of closure ring assembly 30 are provided in the present invention, as illustrated in FIGS. 5A–5C. Looking to FIG. 5A, a first embodiment includes a bolt 38 having a head 42, a threaded cylinder 44, and an unthreaded cylindrical shoulder 40, with the cylindrical shoulder 40 being connected to both the head 42 and the threaded cylinder 44. In a second embodiment illustrated in FIG. 5B, the fastening assembly 37 includes a bolt 38 having a head 42 and a threaded cylinder 44, that is used in conjunction with a slip sleeve 43 or similar disc through which the threaded cylinder 44 may pass. Furthermore, looking to FIG. 5C, an additional embodiment of the fastening assembly 37 is illustrated wherein a threaded sleeve 45 is able to be screwed onto the threaded cylinder 44 to provide the desired shoulder necessary for limiting axial and radial movement of the closure ring 32.

Looking at FIG. 6, a sectional view of the first embodiment of the closure ring assembly 30 is shown. Accordingly, this closure ring assembly 30 serves to lock the lid 6 to the open-head drum 8, and is able to withstand forces applied to the open-head drum 8 without displacement of the lid 6. Each lug 34, 36 has a central cylindrical hole passing transversely therethrough, as indicated by 46, 48. In the preferred embodiment, the first lug 36 of the closure ring assembly 30 has an unthreaded hole 46, and the second lug 34 has a threaded hole 48. The unthreaded hole 46 accommodates the passage of the threaded cylinder 44 of bolt 38 to engage the mating threads of the threaded hole 48 in the lug 34. The two lugs 34, 36 are thereby drawn in proper alignment toward one another by the advancing rotation of the bolt 38 within the threaded hole 48. This movement draws together the adjacent ends 31, 33 of the closure ring 32 to tighten the closure ring 32 about the drum cover.

As stated above, the diameter of the unthreaded hole 46 is chosen such that the threaded cylinder 44 of the bolt 38 can easily pass through the unthreaded hole 46. Typically, the diameter of the threaded cylinder 44 is approximately 0.625 inches and the diameter of the unthreaded hole 46 is approximately 0.734 inches so that the threaded cylinder 44 has ample space to pass through the unthreaded hole 46. Additionally, the unthreaded hole 46 is designed so that the fastening assembly 37 will be substantially flush with the unthreaded hole 46. More specifically, the periphery of the cylindrical shoulder 40, the slip sleeve 43, or the threaded sleeve 45 will be substantially flush with the unthreaded hole 46 when the bolt 38 is inserted into the lugs 34, 36. Preferably, the difference between the diameters of the cylindrical shoulder 40, the slip sleeve 43, or the threaded sleeve 45 and the unthreaded hole 46 will be no more than 0.01 inches. For example, the diameter of the cylindrical shoulder 40 of the preferred embodiment is approximately 0.724 inches. Consequently, the diameter of the unthreaded hole 46 is greater than 0.724 inches but ideally less than or equal to 0.734 inches. Due to the close interaction between the cylindrical shoulder 40, the slip sleeve 43, or the threaded sleeve 45 and the unthreaded hole 46, there is little space for movement of the cylindrical shoulder 40, the slip sleeve 43, or the threaded sleeve 45 within the unthreaded hole 46. Consequently, the use of the cylindrical shoulder 40, the slip sleeve 43, or the threaded sleeve 45 will reduce the displacement of the bolt 38 within the unthreaded lug 36 and reduce the opportunity of the closure ring 32 to loosen from the drum 8.

Figure 1:
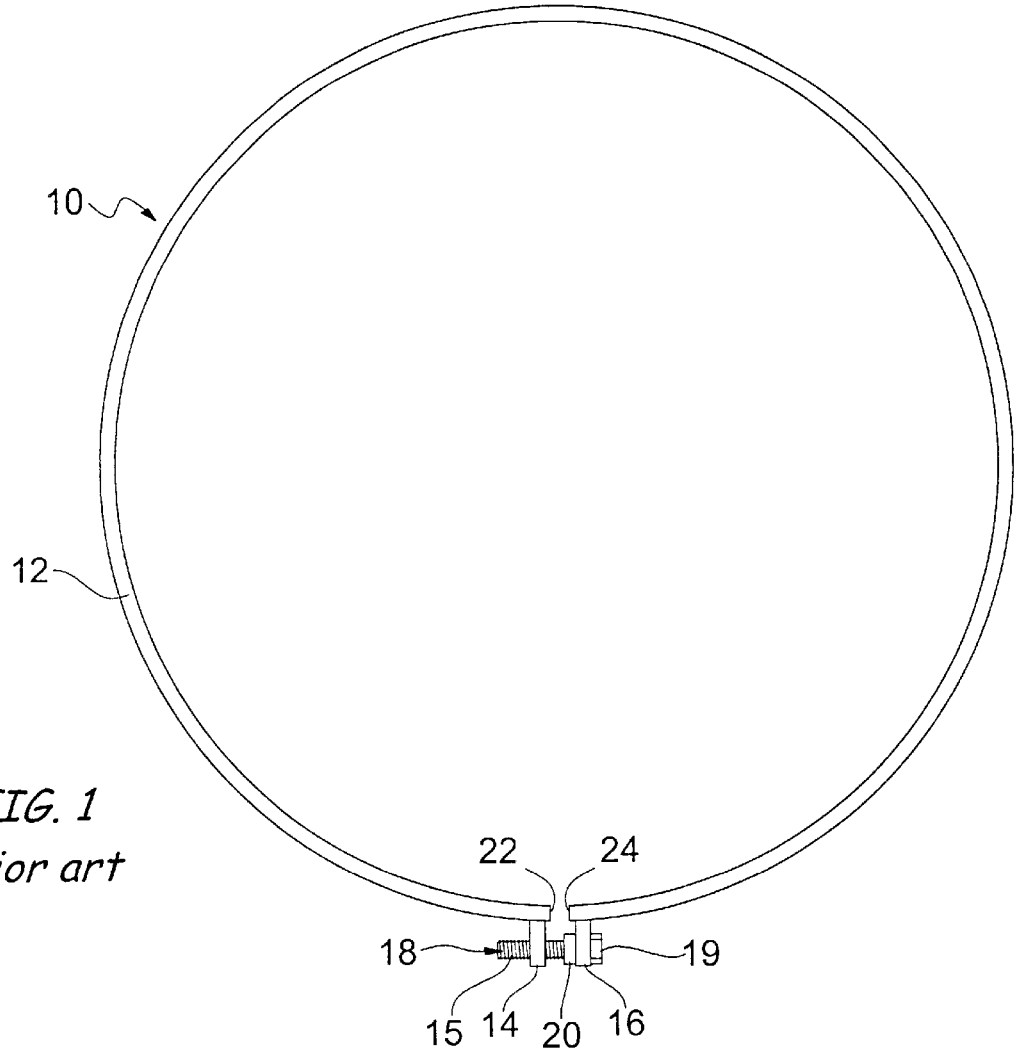
FIG. 1 prior art
FIG. 1 is a top view of a split closure ring assembly of the prior art.
Figure 2:
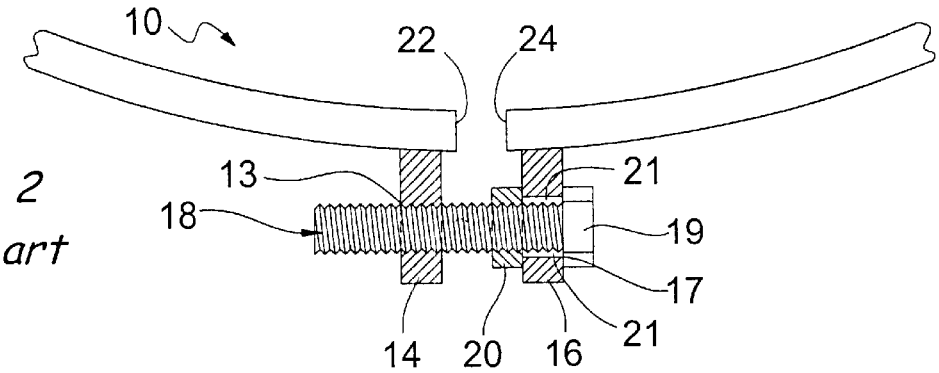
FIG. 2 prior art
FIG. 2 is a partial sectional view of the closure ring assembly of FIG. 1.
Figure 3:
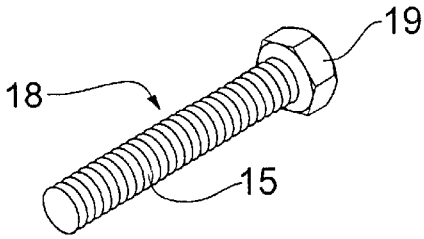
FIG. 3 prior art
FIG. 3 is a perspective view of the bolt of the closure ring assembly of FIG. 1.

This design provides advantages over prior designs in that the adjacent lugs 34, 36 are able to be welded closer to the ends 31, 33 of the closure ring 32 due to the absence of the jam nut 20 (see FIGS. 1 and 2) between the two lugs 34, 36, and are therefore able to be drawn closer together. As a comparative example, in the conventional closure ring assemblies shown in FIGS. 1 and 2, the lugs 14, 16 are welded approximately 0.187 inches from the ends 22, 24 of the closure ring 12 because the jam nut 20, having a width of approximately 0.375 inches, must have the space to fit between them. Further, when the conventional closure ring 12 is closed on a drum, the normal space between the ends 22, 24 of the closure ring 12 is approximately 0.250 inches. This means that conventional closure ring assemblies 10 require a distance of no less than 0.625 inches between the lugs 14, 16. The lugs 34, 36 of the present invention, however, can be mounted on the closure ring 32 a distance of approximately 0.063 inches from the ends 31, 33 since there is no jam nut 20 between the lugs 34, 36. Therefore, the distance between lugs 34, 36 is approximately 0.125 inches when the closure ring 32 is tightened around a drum 8. Consequently, the present invention reduces this distance between the lugs 34, 36 of the closure ring 32 by approximately 0.500 inches from the conventional assembly 10, resulting in a tighter connection between the closure ring 32 and the drum 8.

Additionally, it should further be noted that the closure ring 32 of the present invention is a heavy gauge closure ring (preferably twelve gauge) that is conventionally used with open-head drums. Closure rings 32 that are heavy gauge have a thickness of approximately 0.095 inches, whereas light gauge closure rings (such as sixteen gauge) have a thickness of approximately 0.052 inches. Consequently, light gauge closure rings are more easily bent and maneuvered, but they are not capable of providing the strength that is necessary to secure lids onto open-head drums and to withstand the forces that are applied to open-head drums, especially during hydrostatic and drop testing of the drums.

The embodiment discussed above provides several advantages. First, the two lugs 34, 36 of the present invention are able to be drawn closer together due to the absence of the jam nut 20, which betters the alignment between the lugs 34, 36 for improved performance compared to conventional assemblies. Second, the lugs 34, 36 may be welded close to the ends 31, 33 of the closure ring 32 to provide a tighter and improved seal around the drum 8. In addition, the embodiment of FIG. 6 does not require additional parts (such as the jam nut 20 of FIG. 1) to form a secure connection for the ends of the annular split ring 32, so it is more economical to build and maintain than conventional designs.

Figure 7:
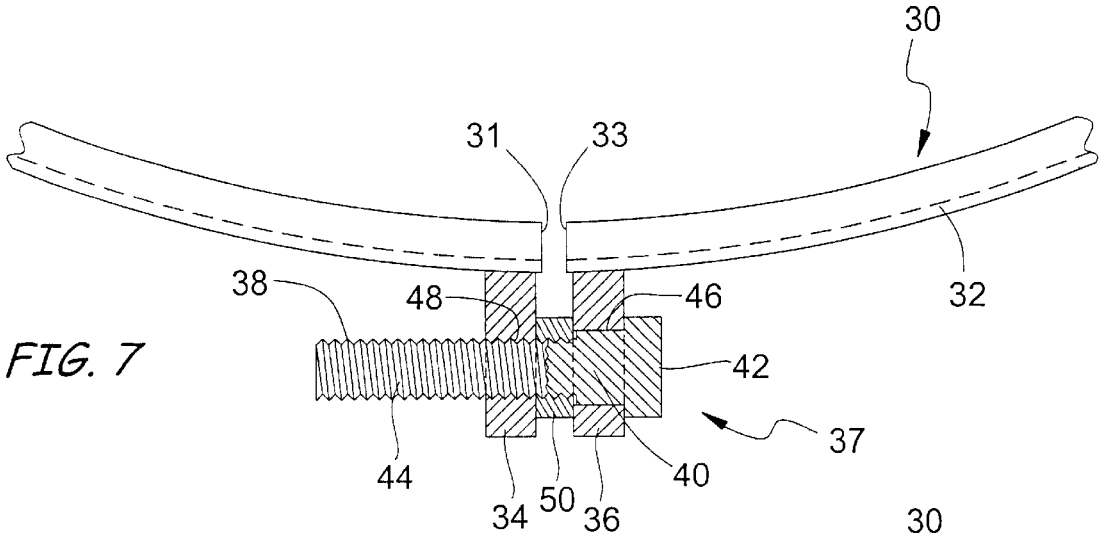
FIG. 7 is a partial sectional view of the embodiment shown in FIG. 6 having an additional jam nut positioned between the lugs.

Looking at FIG. 7, the closure ring assembly 30 of the first embodiment is shown having an additional jam nut 50. Although not necessary to maintain a secure connection in the closure ring assembly 30, this jam nut 50 can be used to reinforce the connection of the bolt 38 with the closure ring 32. Therefore, the jam nut 50 is placed between the lugs 34, 36 to provide contact with the second lug 34 between the jam nut 50 and the head 42 of the bolt 38.

Figure 8:
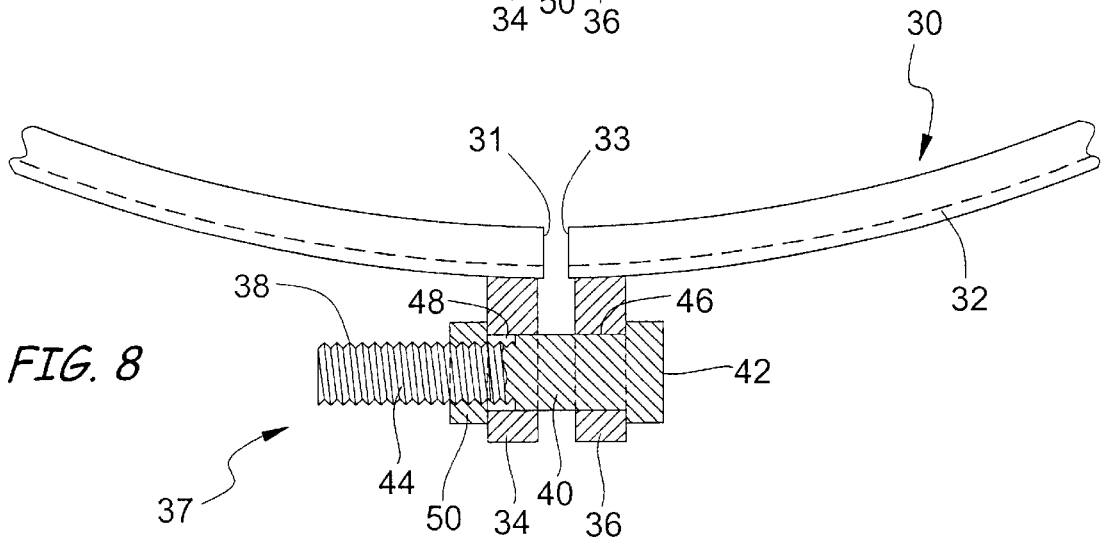
FIG. 8 is a partial sectional view of a second embodiment of the closure ring assembly of the present invention having a pair of lugs with unthreaded holes to receive a bolt having an extended shoulder.

In a second embodiment shown in FIG. 8, the holes 46, 48 in both lugs 34, 36 are unthreaded. In this embodiment, the length of the cylindrical shoulder 40, the slip sleeve 43, or the threaded sleeve 45 is extended so that the periphery of the cylindrical shoulder 40, the slip sleeve 43, or the threaded sleeve 45 will be substantially flush with the holes 46, 48 of both lugs 34, 36 when the lugs 34, 36 are drawn together. In operation, the bolt 38 will initially engage the hole 46 in the first lug 36, and then the hole 48 in the second lug 34. A jam nut 50 is used to engage the bolt 38 after it passes through the hole 48 in the second lug 34, and the interaction between the jam nut 50 and the bolt 38 will draw the ends 31, 33 of the closure ring 32 together.

As stated above, the periphery of the cylindrical shoulder 40, the slip sleeve 43, or the threaded sleeve 45 will be substantially flush with the hole 46 in the first lug 36, and at least a portion of the periphery of the shoulder 40 will be substantially flush with the hole 48 in the second lug 34 once the lugs 34, 36 are drawn closer together. Consequently, the bolt 38 will thereby secure the closure ring assembly 30 to the open-head drum, and the extended cylindrical shoulder 40 (FIG. 5A), slip sleeve 43 (FIG. 5B), or threaded sleeve 45 (FIG. 5C) will help to prevent the undesired movement of the bolt 38 within the holes 46, 48 of both lugs 34, 36. As a result, undesired movement of the closure ring assembly 30 will also be reduced. An additional benefit of this embodiment is that the closure seal ring 32 is easier to manufacture with two unthreaded holes 46, 48 as compared to other closure seal ring assemblies having lugs with threaded holes.

Thus, although there have been described particular embodiments of the present invention of a new and useful CLOSURE RING ASSEMBLY FOR AN OPEN-HEAD DRUM, it is not intended that such references be construed as limitations upon the scope of this invention except as set forth in the following claims.

What is claimed is:

1. An improved closure ring assembly for securing a lid to an open-head drum comprising:

a circular member made of a heavy gauge material, said circular member being split to form a first and second adjacent end;

a fastening assembly including a bolt including a head member and a threaded cylindrical member, and shoulder engaging said threaded cylindrical member, wherein said shoulder comprises a threaded sleeve detachably engaging threaded cylindrical member;

a first lug extending outwardly from said first end of said circular member, said first lug including a first hole for receiving said threaded cylindrical member and said cylindrical shoulder such that a perimeter of said cylindrical shoulder is substantially flush with a perimeter of said first hole; and a second lug extending outwardly from said second end of said circular member, said second lug including a second hole for receiving said threaded cylindrical member.

2. The assembly of claim 1 wherein a perimeter of said second hole is threaded to engage said threaded cylindrical member.

3. The assembly of claim 1 wherein a diameter of said first hole is greater than a diameter of said cylindrical shoulder by approximately 0.01 inches.

4. The assembly of claim 1 wherein the thickness of said closure ring is approximately 0.09 inches.

5. The assembly of claim 1 wherein said shoulder is resolutely fastened to said threaded cylindrical member.

6. The assembly of claim 1 wherein said shoulder is a slip sleeve sliding over said threaded cylindrical member.

7. The assembly of claim 1 wherein said sleeve is a slip sleeve sliding over said threaded cylindrical member.

8. An assembly for securing a lid to a cylindrical container comprising:

a split annular ring made of a heavy gauge material, said split annular ring having a first and second end;

a fastening assembly comprising a bolt having a head member and a threaded cylindrical member; and a sleeve engaging said threaded cylindrical member, wherein said sleeve is attached to said threaded cylindrical member;

a first lug extending outwardly from said first end of said split annular ring, said first lug including a first hole for receiving said threaded cylindrical member and said sleeve such that said sleeve is substantially flush with a perimeter of said second hole; and a second lug extending outwardly from said second end of said split annular ring, said second lug including a threaded hole for engaging said threaded cylindrical member.

9. The assembly of claim 8 wherein a diameter of said first hole is greater than a diameter of said sleeve by approximately 0.01 inches.

10. The assembly of claim 8 wherein the surface of said second hole is threaded to engage said threaded cylindrical member of said bolt.

11. The assembly of claim 8 further comprising a sleeve operable to engage said threaded cylindrical member between said first lug and said second lug.

12. The assembly of claim 8 wherein said sleeve is a threaded sleeve detachably attached to said threaded cylindrical member.

13. An assembly for securing a lid to a cylindrical container comprising:

an annular split ring made of heavy gauge material, said annular split ring having a first and second end;

a bolt having a head member and a threaded cylindrical member;

a cylindrical shoulder engaging said threaded cylindrical member, wherein said cylindrical shoulder is a threaded sleeve detachably engaging threaded cylindrical member;

a first lug extending outwardly from said first end of said split annular ring, said first lug including a first unthreaded hole for receiving said threaded cylindrical member and said cylindrical shoulder such that said cylindrical shoulder is substantially flush with a periphery of said first unthreaded hole;

a second lug extending outwardly from said second end of said split annular ring, said second lug including a second unthreaded hole for receiving said threaded cylindrical member and said cylindrical shoulder such that said cylindrical shoulder is substantially flush with a periphery of said second unthreaded hole; and a sleeve operable to engage said threaded cylindrical member.

14. The assembly of claim 13 wherein said cylindrical shoulder is resolutely fastened to said threaded cylindrical member.

15. The assembly of claim 13 wherein said cylindrical shoulder is a slip sleeve sliding over said threaded cylindrical member.

16. The assembly of claim 13 wherein a diameter of said first and second unthreaded holes is greater than a diameter of said cylindrical shoulder by no more than 0.01 inches.

17. The assembly of claim 13 further comprising a second sleeve operable to engage said threaded cylindrical member after said second lug.

18. An improved closure ring assembly for securing a lid to an open head drum comprising:

a circular member split to form a first and second adjacent end;

a bolt including a head member, a cylindrical shoulder, and a threaded cylindrical member;

a first lug extending outwardly from said first end of said circular member, said first lug including a first hole for receiving said threaded cylindrical member and said cylindrical shoulder such that a perimeter of said cylindrical shoulder is substantially flush with a perimeter of said first hole; and a second lug extending outwardly from said second end of said circular member, said second lug including a second hole for receiving said threaded cylindrical member, wherein the perimeter of said cylindrical shoulder is substantially flush with the perimeter of said second hole.

19. The assembly of claim 18 wherein a perimeter of said second hole is threaded to engage said threaded cylindrical member.

20. The assembly of claim 18 wherein a diameter of said first hole is greater than a diameter of said cylindrical shoulder by approximately 0.01 inches.

21. The assembly of claim 18 further comprising a nut to engage said threaded cylindrical member to secure said bolt to said first and said second lugs.

22. The assembly of claim 18 wherein a diameter of said second hole is greater than a diameter of said cylindrical shoulder by approximately 0.01 inches.

* * * * *